US006450338B1

(12) United States Patent
Chen

(10) Patent No.: US 6,450,338 B1
(45) Date of Patent: Sep. 17, 2002

(54) FAST-ACCESSIBLE SOCKET RETAINER

(76) Inventor: Andrew Chen, Room 1003, 10F, No. 96, Sec. 2, Chung-Shan N. Road, Taipei (TW)

( * ) Notice: Subject to any disclaimer, the term of this patent is extended or adjusted under 35 U.S.C. 154(b) by 0 days.

(21) Appl. No.: 09/692,679

(22) Filed: Oct. 18, 2000

(51) Int. Cl.[7] ..... B65D 85/28

(52) U.S. Cl. ..... 206/378; 206/493; 206/806; 211/70.6

(58) Field of Search ..... 206/378, 376, 206/377, 372, 493, 806; 211/70.6; 24/3.11, 3.12, 3.13

(56) References Cited

U.S. PATENT DOCUMENTS 1,286,501 A * 12/1918 Bauer ..... 59/85
3,852,982 A * 12/1974 Faris ..... 70/457
5,139,144 A * 8/1992 Robert, Jr. ..... 206/378
5,535,881 A * 7/1996 Krivec ..... 206/376
5,862,913 A * 1/1999 Chou ..... 206/378
5,893,498 A * 4/1999 Aronson ..... 224/255
5,975,297 A * 11/1999 Kao ..... 206/378
6,044,985 A * 4/2000 Kao ..... 211/70.6
6,092,655 A * 7/2000 Ernst ..... 206/378
6,092,656 A * 7/2000 Ernst ..... 206/378
6,095,329 A * 8/2000 Kao ..... 206/378
6,098,799 A * 8/2000 Lee ..... 206/378
6,109,491 A * 8/2000 Aronson ..... 224/255

* cited by examiner

*Primary Examiner*—Shian Luong

(57) ABSTRACT

A fast-accessible socket retainer mainly comprises a socket holder and at least a snap fastener, wherein the snap fastener further comprises: a main body having at least a through hole; a flexible buckling portion coupled to the main body; a depressing portion jointed to the buckling portion; at least a protruding part on the outer surface of the buckling portion; and a resilient member disposed between the depressing portion and the main body. When a wrench socket is collared onto a snap fastener, the protruding part of the buckling portion will be choked in a pit in the inner wall of a buckling concavity. The socket holder comprises a flexible bar and a holding means disposed at two ends of the flexible bar, wherein the flexible bar is arranged penetrating the through holes of the snap fasteners and fixed with the holding means for easy storing, collecting, or displaying of the wrench sockets.

5 Claims, 6 Drawing Sheets

FAST-ACCESSIBLE SOCKET RETAINER

BACKGROUND OF THE INVENTION

1. Field of the Invention

This invention relates generally to a socket retainer, more particularly to a fast-accessible socket retainer that can hold a plurality of snap fasteners in series for retaining wrench sockets and for facilitating fast fetch or exchange of the same.

2. Description of the Prior Art

Wrench sockets of socket wrench are usually disposed in a toolbox in order to facilitate easy fetch or exchange at job sites, however, the toolbox may become an extra burden for people to carry occasionally.

The related prior art of a socket hanger mainly comprises: a main body for hanging wrench sockets on both sides; a snap fastener having a hanging pocket being disposed at a terminal edge of the main body; the hanging pocket being bent upwardly to form a hook; a snap piece formed on the main body for the shank of a wrench; a receptacle in the main body for accommodating a wrench head; a dovetail formed on two respective sides of the main body to become a dovetail portion, wherein one end of the dovetail portion is a close end while the other an open end; a plurality of suspending weights secured to the dovetail portion; and a choking portion disposed on the suspending weights for jointing with wrench sockets.

This socket hanger is advantageous in weight than a conventional toolbox but disadvantageous in its complicated structure and in fast fetch or exchange of the wrench sockets.

SUMMARY OF THE INVENTION

The primary object of this invention is to provide a fast-accessible socket retainer holding a plurality of snap fasteners for fast fetch or exchange of wrench sockets.

Another object of this invention is to provide a fast-accessible socket retainer having a flexible socket holder for easy retaining of a plurality of snap fasteners in series.

In order to realize abovesaid objects, a fast-accessible socket retainer of this invention mainly comprises a socket holder and at least a snap fastener. The snap fastener further comprises: a main body having at least a through hole; a flexible buckling portion coupled to the main body; a depressing portion jointed to the buckling portion; at least a protruding part on the outer surface of the buckling portion; and a resilient member disposed between the depressing portion and the main body. When a wrench socket is collared onto a snap fastener, the protruding part of the buckling portion of a snap fastener will be choked in a pit in the inner wall of the wrench socket. Further, the socket holder comprises a flexible bar and a holding means disposed at two ends of the flexible bar, wherein the flexible bar is arranged penetrating the through holes of the snap fasteners and fixed with the holding means for easy storing, collecting, or displaying of wrench sockets.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
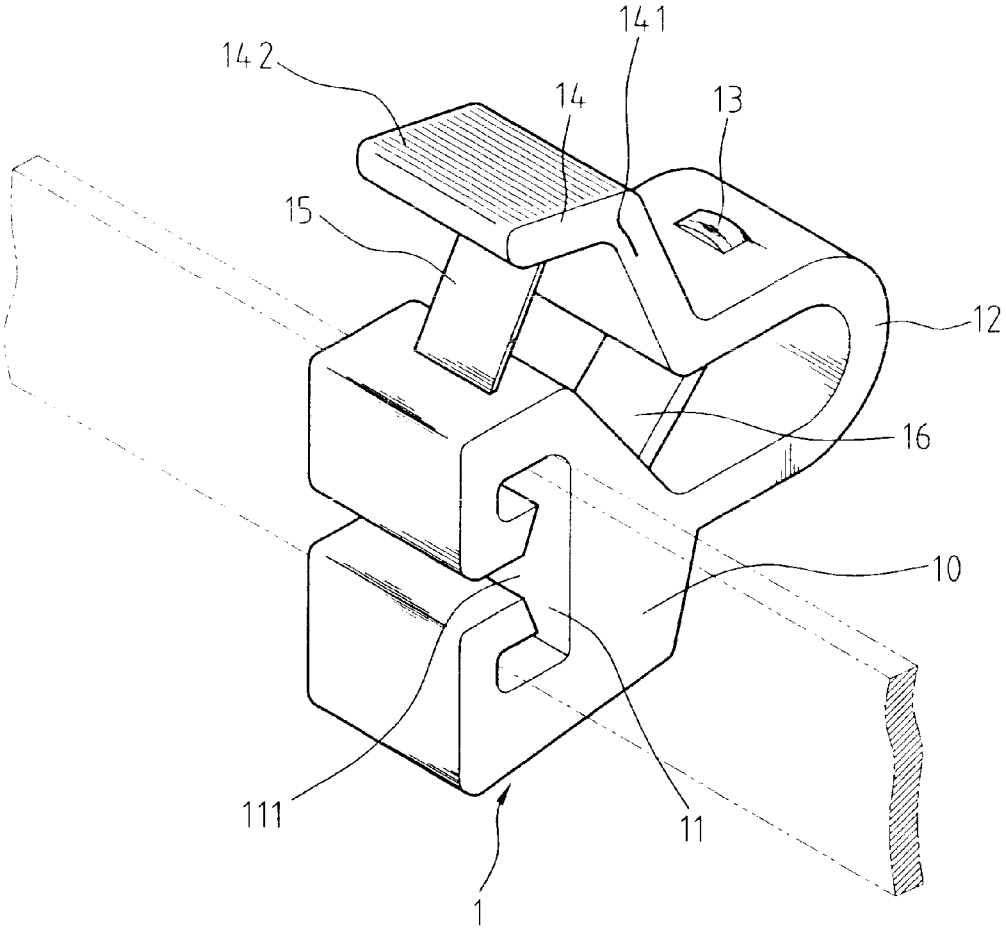
FIG. 1 is a structural view of a snap fastener of this invention in three dimensions.

A fast-accessible socket retainer of this invention mainly comprises a socket holder 2 and at least a snap fastener 1. In a preferred embodiment shown in FIG. 1, the snap fastener 1 further comprises: a main body 10 having at least a through hole 11; an opening 111 formed in the main body 10 communicable with the through hole 11; a flexible buckling portion 12 extended from the main body 10 at an opposite side with respect to the opening 111, wherein the buckling portion 12 is U-shaped in a preferred embodiment; one end of the U-shaped buckling portion 12 is coupled to the main body 10 while the other end is a free end which is further processed to form a two-segment depressing portion 14; at least a protruding part 13 is disposed on the outer surface of the buckling portion 12; at least a first resilient member 15 is arranged between the main body 10 and the free end of the buckling portion 12; and the main body 10 is further extended to form a second resilient member 16 probing into the U-shaped space with no tail end thereof touching the inner wall of the buckling portion 12.

First and second resilient members 15, 16 push the depressing portion 14 outwards to ensure that the socket is tightly locked and retained. As can be seen from FIG. 1, the depressing portion 14 of this invention has a slanted segment 141 which is extended from the free end of the buckling portion 12, and a flat segment 142 which is extended from the slanted segment. The flat segment 142 allows a user to easily depress the depressing portion of the socket retainer so as to release a wrench socket that has been locked by the protruding part 13.

A user may use his fingers to apply an external force on the depressing portion 14 to have the first and the second resilient member 15, 16 oppressed to deposit energy, which will be released to restore the depressing portion 14 and the buckling portion 12 when the external force is removed.

Figure 2:
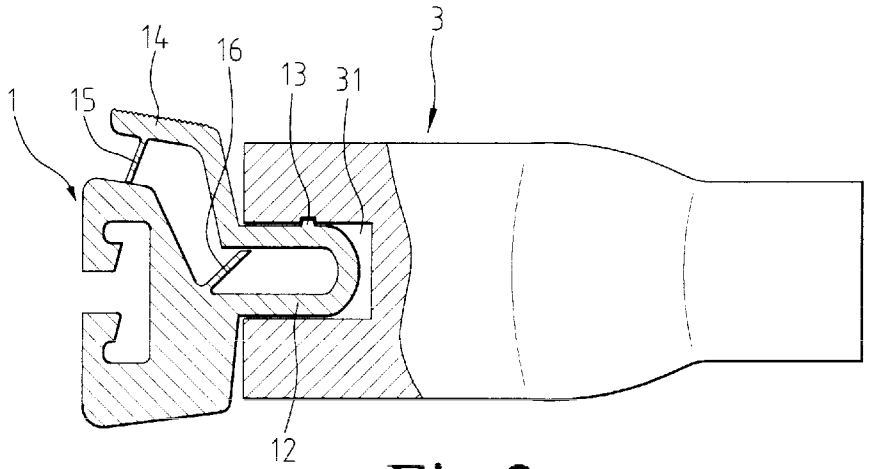
FIG. 2 is a cutaway sectional view showing a wrench socket fixed on a snap fastener of this invention.
Figure 3:
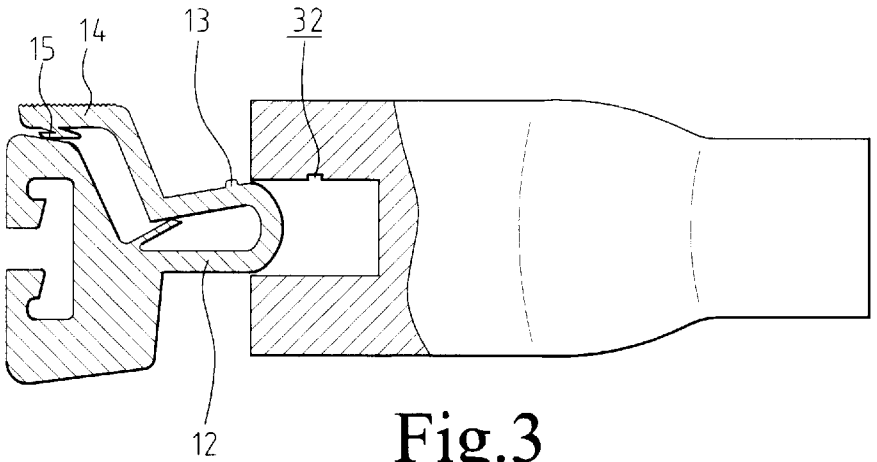
FIG. 3 is a cutaway sectional view showing the wrench socket departed from the snap fastener of this invention.

As indicated in FIGS. 2 and 3, a typical wrench socket 3 for wrench tool is generally provided with a buckling concavity 31 with a pit 32 disposed in an inner wall thereof, so that the protruding part 13 can be embedded in the pit 32 to have the buckling portion 12 and the wrench socket 3 jointed together after the buckling portion 12 has been oppressed by the depressing portion 14 to enter the buckling concavity 31 of the wrench socket 3 and the external force has been removed to restore the buckling portion 12 and the depressing portion 14.

Figure 4:
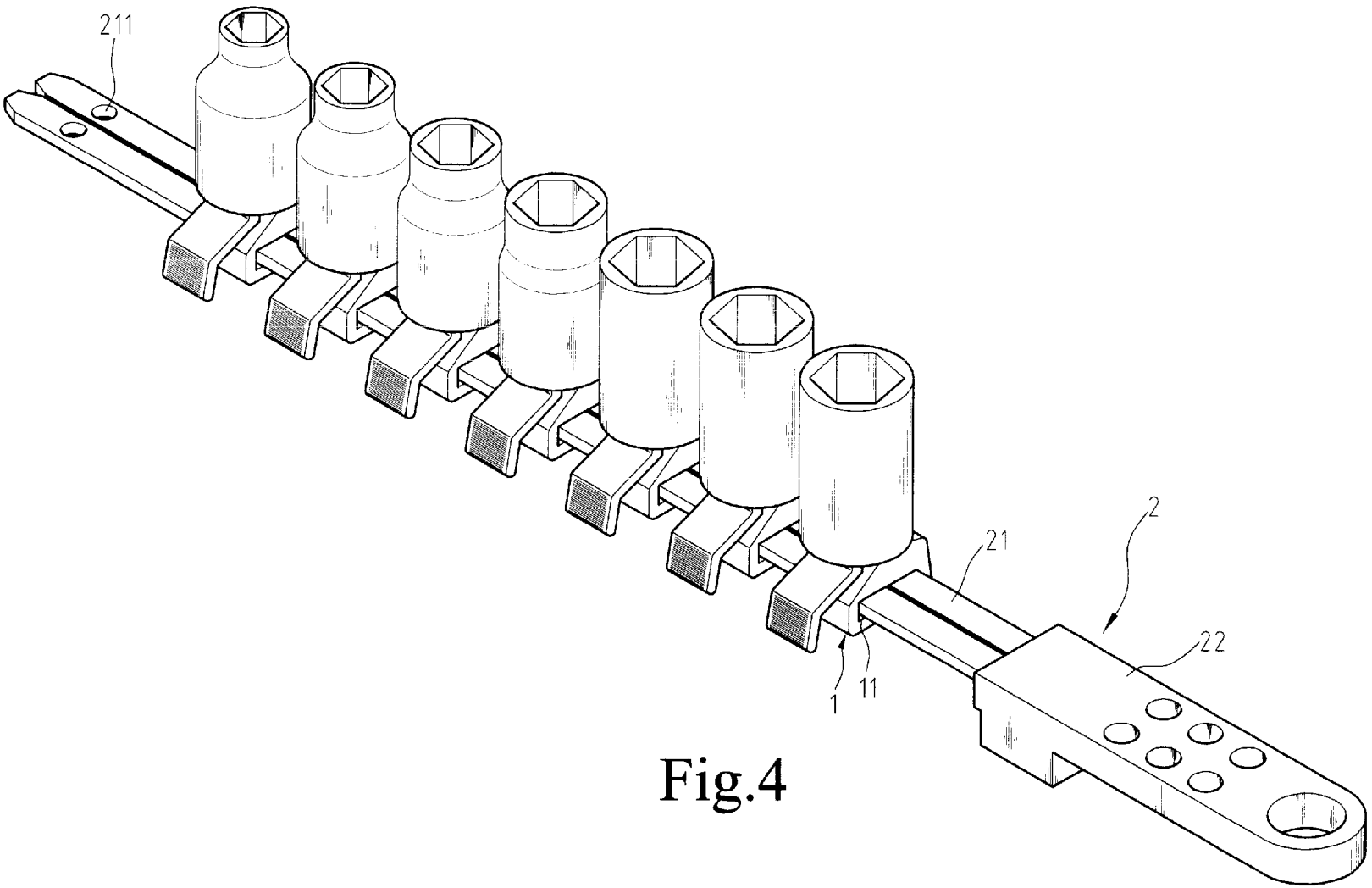
FIG. 4 is a schematic perspective view showing that a socket holder penetrates the through holes of a plurality of snap fasteners to hold the wrench sockets fixed to the snap fasteners.
Figure 5:
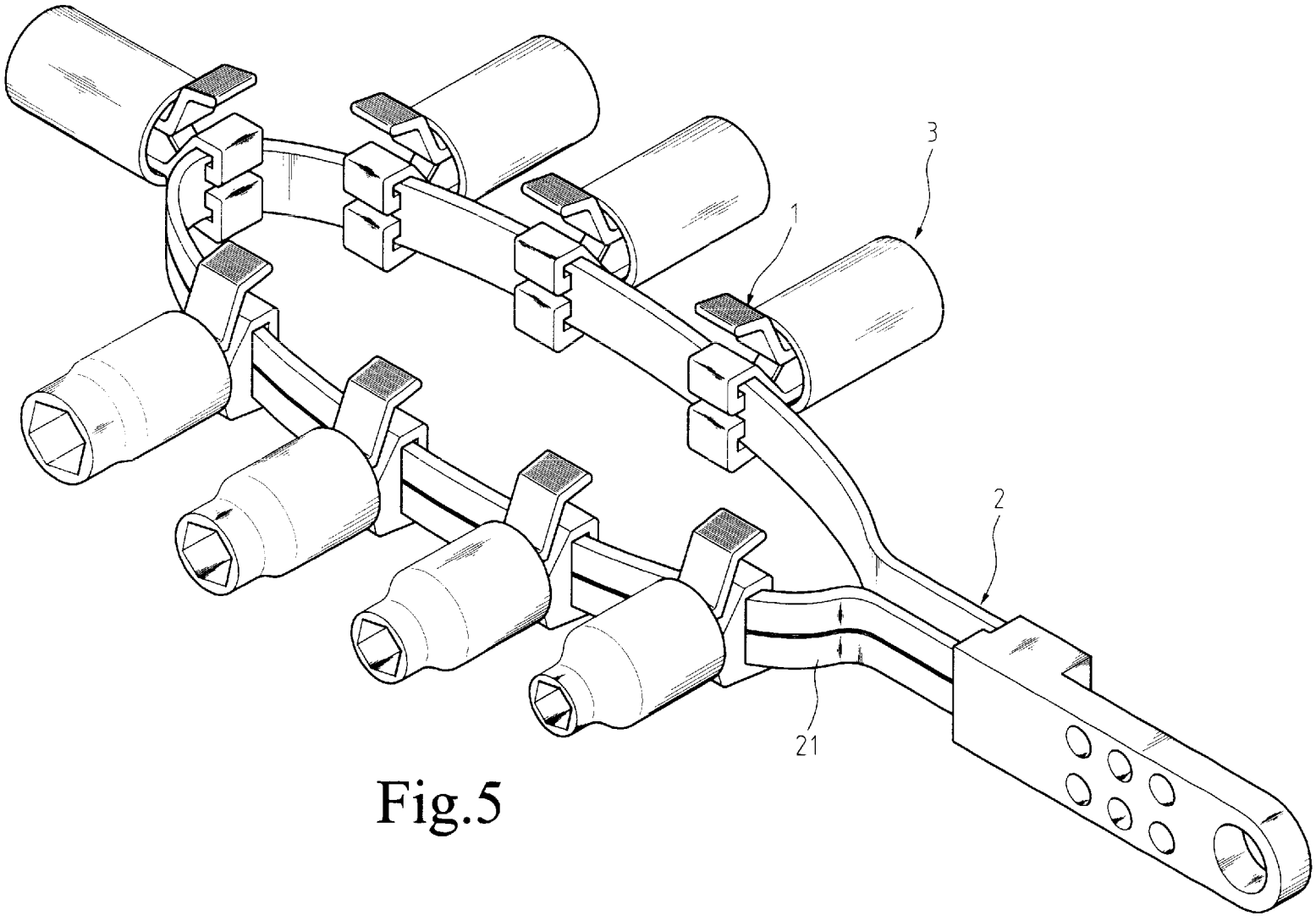
FIG. 5 is a perspective view showing two ends of the socket holder shown in FIG. 4 are closed to prevent the snap fasteners from escaping.
Figure 6:
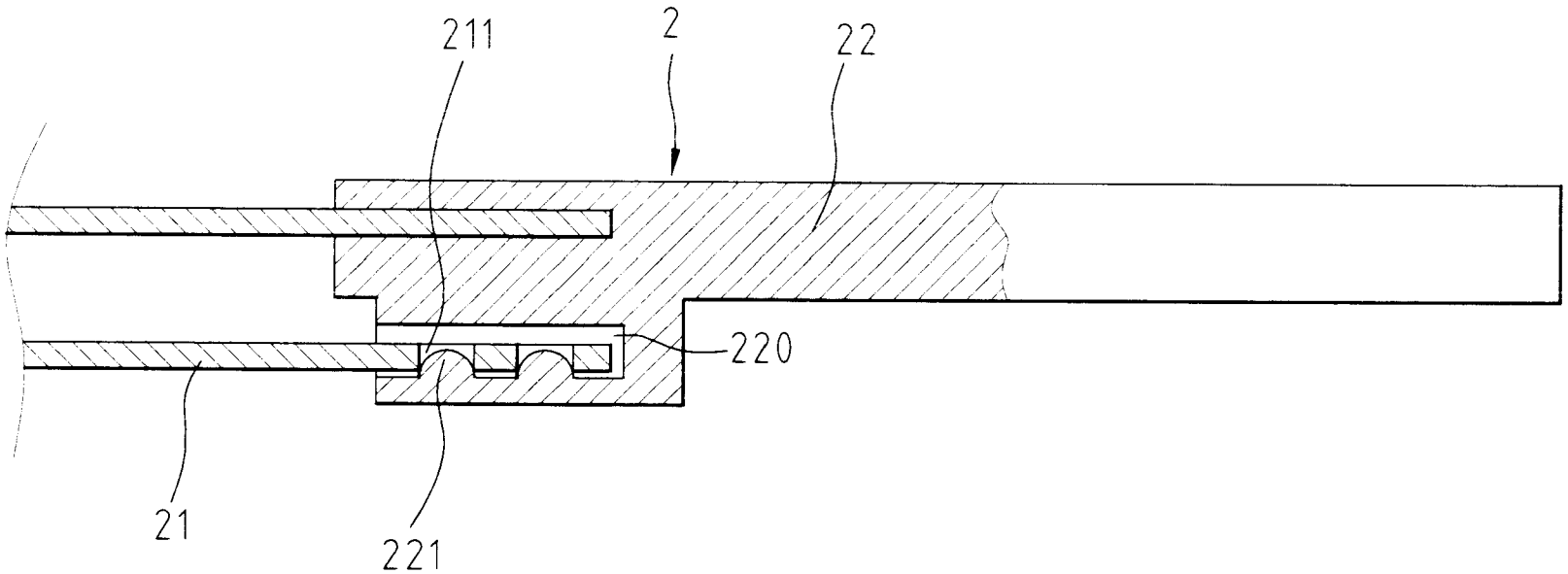
FIG. 6 is a cutaway sectional view showing two ends of the socket holder fixed at an anchoring head.

In a preferred embodiment shown in FIG. 4, the socket holder 2 further comprises a flexible bar 21 and a holding means disposed at each end thereof including an anchoring head 22 at one end and a plurality of anchoring holes 211 at the other. Moreover, as shown in FIG. 6, a receptacle 220 which is provided with a plurality of humps 221 formed in an inner wall thereof is disposed in the anchoring head 22 for receiving one end of the flexible bar 21 such that the flexible bar 21 can penetrate the through holes 11 of a plurality of the snap fasteners 1, then is bent 180 degrees (as shown in FIG. 5) to have the other end plugged in the receptacle 220 of the anchoring head 22. Under this situation, because of the outward impulsive force of the flexible bar 21, the humps 221 are choked in the through holes 211 to prevent the snap fasteners 1 from detaching from the flexible bar 21. On the contrary, when fetching the flexible bar 21 is desired, a user is supposed to hold the flexible bar 21 shown in FIG. 6 and lift it up to have the through holes 211 released from the humps 221.

Figure 7:
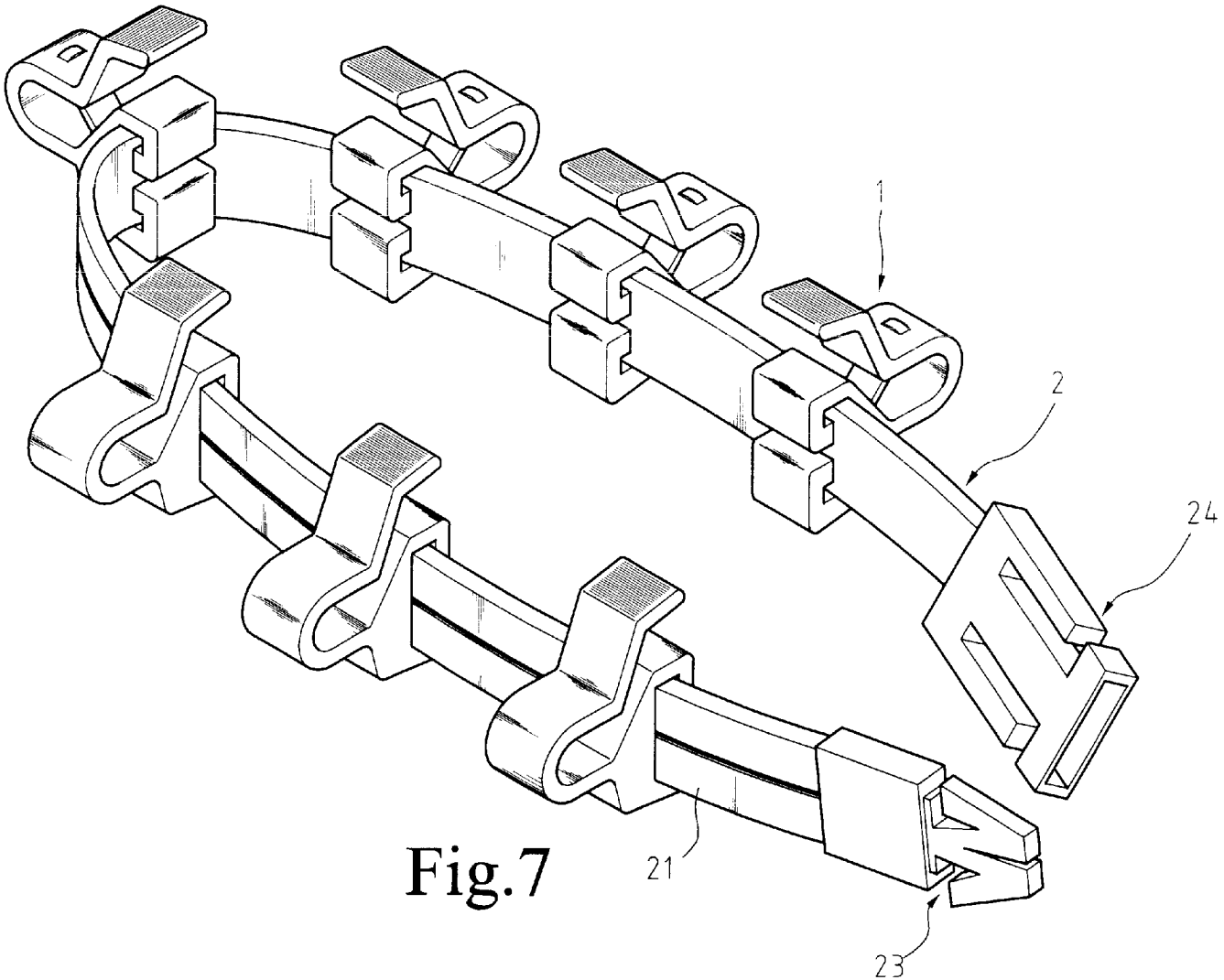
FIG. 7 shows another embodiment of the socket holder retaining the snap fasteners in series.

Another embodiment of the socket holder 2 is shown in FIG. 7, wherein a first or a second retainer 23, 24 is disposed at each of two ends of the flexible bar 21 respectively. After penetrating the through holes 11 of the snap fasteners 1, the first and the second retainer 23, 24 can be locked to close the flexible bar 21, or contrarily, the retainers 23, 24 can be opened to untie the socket holder 2. And, the retainers 23, 24 may be made the same with that of the conventional safety belts for cars and need no more iteration here.

In the above described, at least one preferred embodiment has been elucidated with reference to the drawings annexed, and it is apparent that numerous variations or modifications may be made without departing from the true spirit and scope thereof, as set forth in the claims below.

What is claimed is:

1. A fast-accessible socket retainer, comprising:

at least one snap fastener having a main body with a through hole formed therein, a U-shaped flexible buckling portion having a fixed end connected to said main body, and a depressing portion having a slanted segment extended from a free end of said buckling portion and a flat segment extended from said slanted segment, said buckling portion having a protruding part formed on an outer surface; and a socket holder comprising a flexible bar for passing through said through hole of said main body, said flexible bar having a first end connected to an anchoring head and a second end formed with an anchoring device, said anchoring head having a receptacle for receiving said anchoring device;

wherein said receptacle of said anchoring head comprises a plurality of humps formed on an inner surface of said receptacle, said anchoring device comprises a plurality of retaining holes, and said humps are coupled to said retaining holes when said anchoring device is received in said receptacle.

2. The fast-accessible socket retainer as claimed in claim 1, further comprising a first resilient member between said main body and said free end of said buckling portion.

3. The fast-accessible socket retainer as claimed in claim 2, said first resilient member being extended from an outer surface of main body towards said free end of said buckling portion.

4. The fast-accessible socket retainer as claimed in claim 1, further comprising a second resilient member between said main body and said flat segment of said depressing portion.

5. The fast-accessible socket retainer as claimed in claim 4, said second resilient member being extended from an inner surface of said flat segment of said depressing portion towards said main body.

* * * * *